US005497898A

United States Patent [19]

Perez

[11] Patent Number: 5,497,898

[45] Date of Patent: Mar. 12, 1996

[54] CONTAINER/CLOSURE ASSEMBLY

[76] Inventor: Antonio Perez, 59-35 160 St., Flushing, N.Y. 11365

[21] Appl. No.: 264,265

[22] Filed: Jun. 23, 1994

[51] Int. Cl.[6] ..... B65B 7/28; B65D 35/44; B65D 43/04

[52] U.S. Cl. ..... 220/358; 220/200

[58] Field of Search ..... 220/4.02, 200, 220/357, 358, 378, DIG. 19; 215/364

[56] References Cited

U.S. PATENT DOCUMENTS

| | | |
|---|---|---|
| 2,497,827 | 2/1950 | Trafton . |
| 2,721,595 | 10/1955 | Nichols . |
| 3,396,269 | 8/1968 | Sorenson . |
| 3,749,277 | 7/1973 | Kinney . |
| 4,363,420 | 12/1982 | Andrews . |
| 4,421,246 | 12/1983 | Schultz et al. . |
| 4,588,105 | 5/1986 | Schmitz et al. . |
| 4,761,319 | 8/1988 | Kraus et al. . |
| 4,883,194 | 11/1989 | Fernandes . |
| 5,181,626 | 1/1993 | Daenen et al. . |

*Primary Examiner*—David Scherbel
*Assistant Examiner*—Randall E. Chin
*Attorney, Agent, or Firm*—Bradford E. Kile; Ruffin B. Cordell; Michael J. McKeon

[57] ABSTRACT

A preferred embodiment of the invention which is intended to accomplish the foregoing includes a container/closure assembly having lid means with a plurality of lid extensions. The lid extensions extend from an inner surface of the lid means. Significantly, the lid extensions include pressure means which interacts with a wall surface(s) of the container to secure the lid means on the container. The pressure means is replaceable in order to allow for a controlled lid retention force.

16 Claims, 5 Drawing Sheets

CONTAINER/CLOSURE ASSEMBLY

BACKGROUND OF THE INVENTION

The present invention relates to containers having closure lids. More specifically, an improved container/closure assembly having a lid means which is formed with lid extensions which contact the container wall surface(s) of a container when the lid means is secured to cover a container opening.

Containers have been known to come in a variety of shapes and sizes to accommodate a variety of different contents. The containers are designed in such a way so as to accommodate a closure lid thereby safely securing the contents within the container.

One of the most popular type of container/closure assemblies utilizes a tab and groove design which "locks" the closure lid to the container. Although this design may prove satisfactory in disposable type containers, such as disclosed in U.S. Pat. No. 3,749,277 to Kinney, it has many defects when used for containers which are used for many years to store contents and which have many opening/closing cycles. First, the closure lids are difficult to remove and replace when they are relatively new because the tab and grooves are rigid and do not allow for easy mating. Second, the tabs and grooves wear and distort after many opening/closing cycles proving for difficult opening and closing of the closure lid. In some tab and groove designs, the tab and grooves lose resiliency thereby possessing poor securing ability. Furthermore, the tab and groove designs require complex manufacturing molds which increase the manufacturing cost.

It would be highly desirable to provide a container/closure assembly which has a rugged and durable design which will allow for unlimited opening/closing cycles while still allowing for easy opening and closing of the closure lid.

The difficulties and limitations suggested in the preceding are not intended to be exhaustive, but rather are among many which demonstrate that container/closure assemblies appearing in the past will admit to worthwhile improvement.

OBJECTS AND BRIEF SUMMARY OF THE INVENTION

It is therefore a general object of the invention to provide a novel container/closure assembly which will obviate or minimize difficulties of the type previously described.

It is a specific object of the invention to provide a container/closure assembly which will allow for easy opening and closing of the container with the closure lid, yet provide a sturdy and reliable connection between the container and closure lid.

It is another object of the invention to provide a container/closure assembly which will allow an indefinite number of opening and closing cycles.

It is still another object of the invention to provide a container/closure assembly wherein the closure lid can be altered to allow for varying degrees of closing pressure.

It is a further object of the invention to provide a container/closure assembly wherein the closure lid can be altered when lid parts wear and distort after many opening/closing cycles.

It is yet a further object of the invention to provide a container/closure assembly which can be manufactured by through the use of simple mold designs thereby reducing overall production cost.

BRIEF SUMMARY OF A PREFERRED EMBODIMENT OF THE INVENTION

A preferred embodiment of the invention which is intended to accomplish the foregoing includes a container/closure assembly having lid means with a plurality of lid extensions. The lid extensions extend from an inner surface of the lid means. Significantly, the lid extensions include pressure means which interacts with a wall surface(s) of the container to secure the lid means on the container. The pressure means is replaceable in order to allow for a controlled lid retention force.

DRAWINGS

Other objects and advantages of the present invention will become apparent from the following detailed description of a preferred embodiment thereof taken in conjunction with the accompanying drawings, wherein.

Figure 3A:
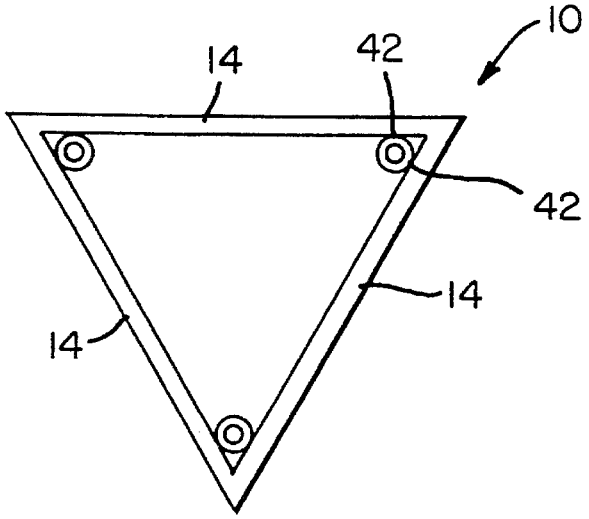

FIG. 3*a* is a schematic plan cut-away view of the closure lid in a container closing position of a triangular cross-sectioned shaped container/closure embodiment.

Figure 3B:
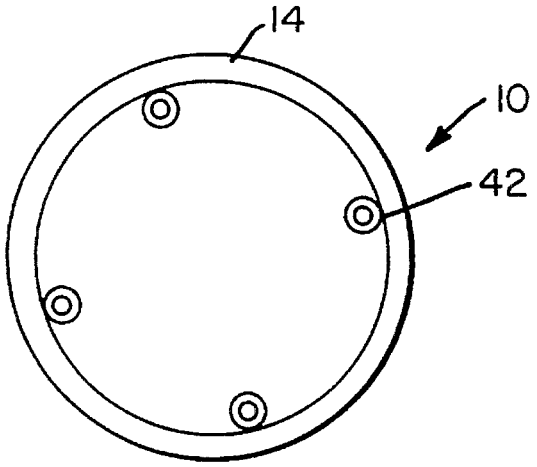

FIG. 3*b* is a schematic plan cut-away view of the closure lid in a container closing position of a circular cross-sectioned shaped container/closure embodiment.

Figure 3C:
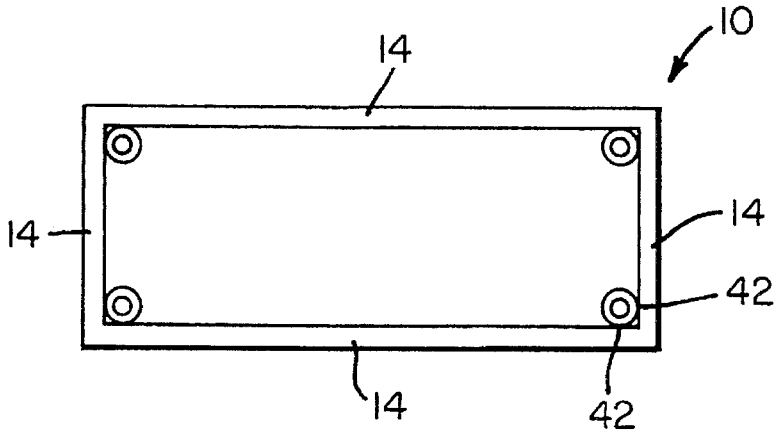

FIG. 3*c* is a schematic plan cut-away view of the closure lid in a container closing position of a rectangular cross-sectioned shaped container/closure embodiment.

Figure 4A:
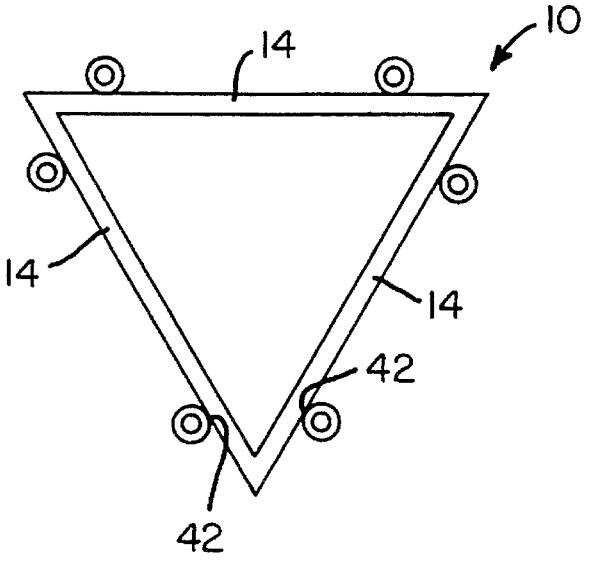

FIG. 4*a* is a schematic plan cut-away view of the closure lid in a container closing position of a triangular cross-sectioned shaped container/closure of an additional embodiment.

Figure 4B:
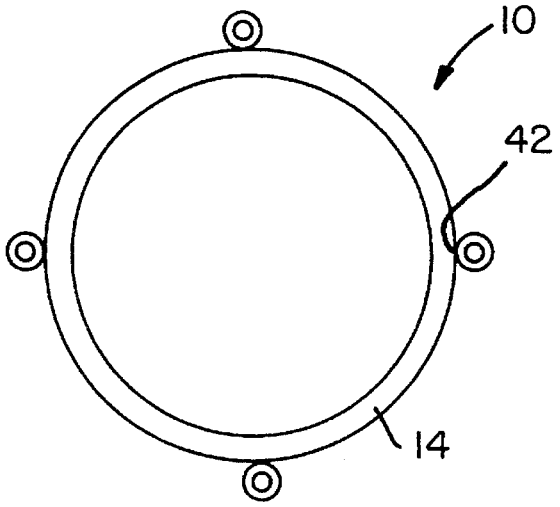

FIG. 4*b* is a schematic plan cut-away view of the closure lid in a container closing position of a circular cross-sectioned shaped container/closure of an additional embodiment.

Figure 4C:
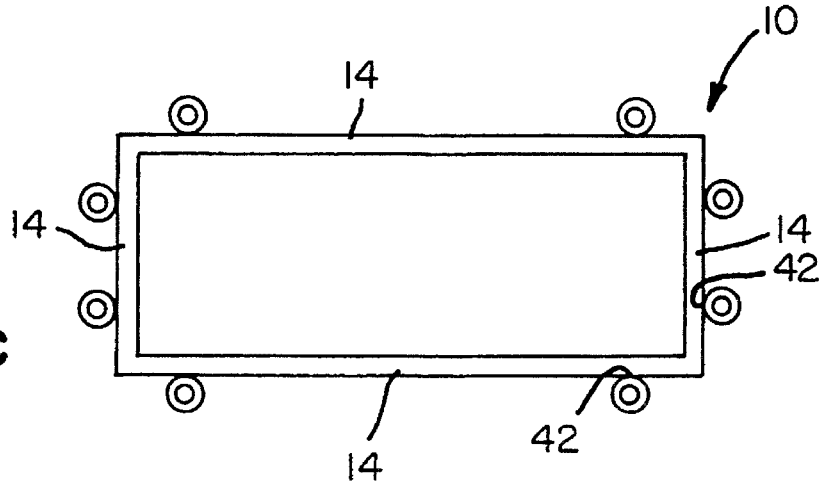

FIG. 4*c* is a schematic plan cut-away view of the closure lid in a container closing position of a rectangular cross-sectioned shaped container/closure of an additional embodiment.

Figure 5A:
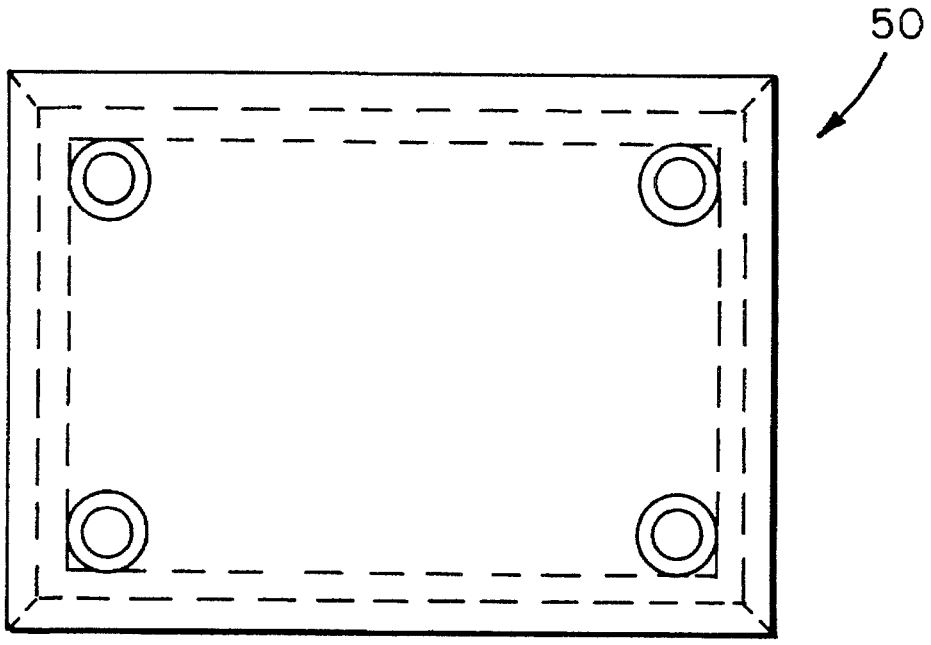
Figure 5B:
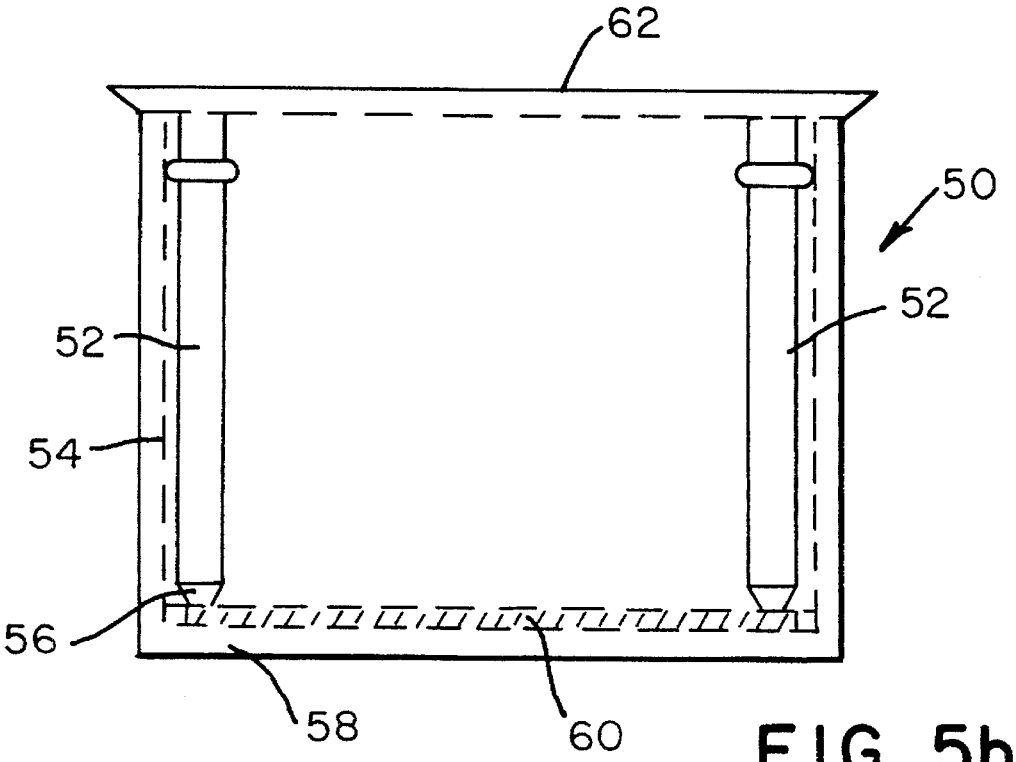

FIGS. 5*a* and 5*b* show a plan and elevation view respectfully of an alternative embodiment of the invention.

Figure 6A:
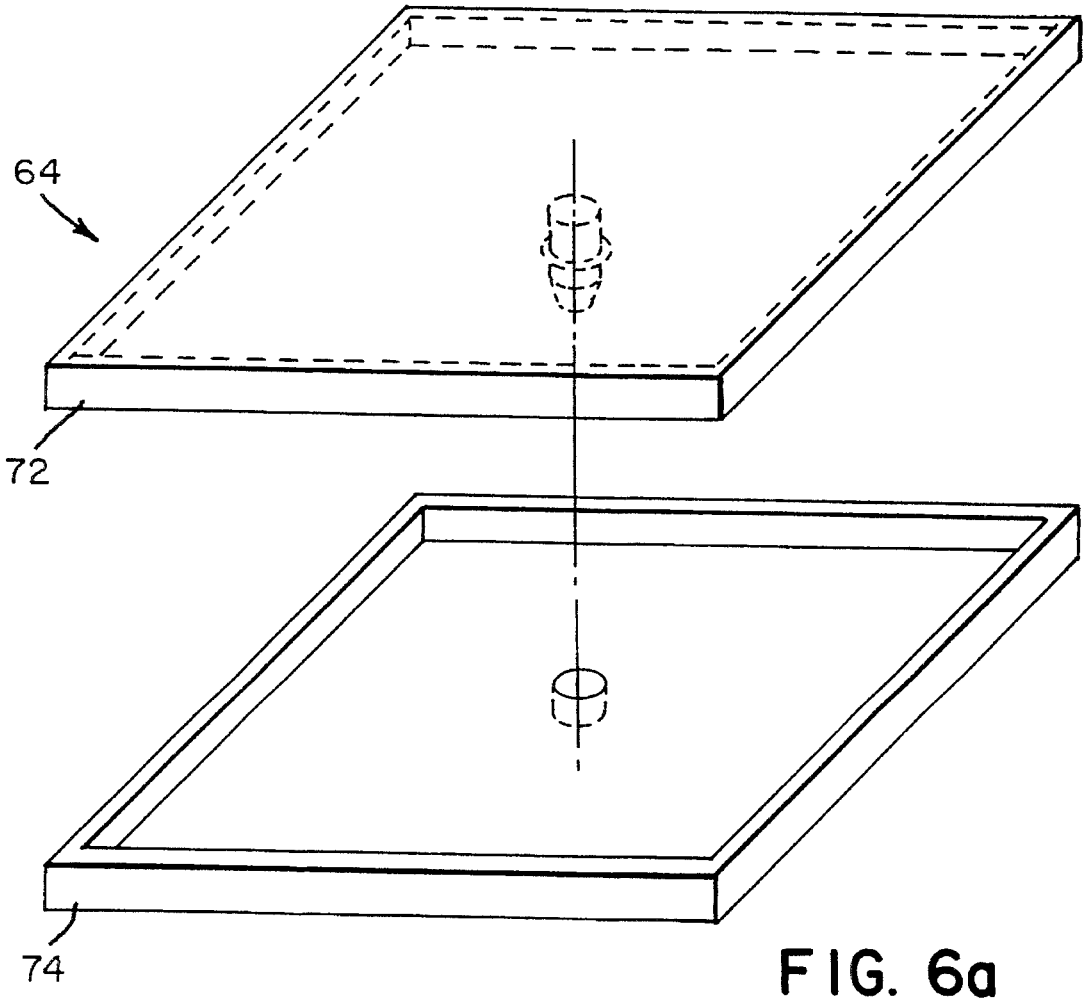
Figure 6B:
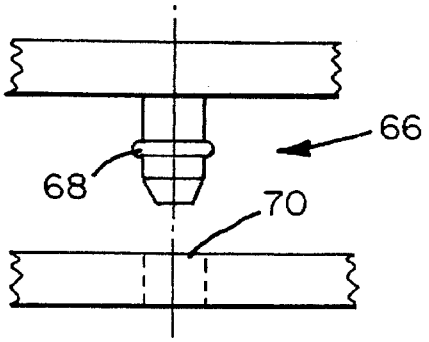

FIGS. 6*a* and 6*b* show a isometric and elevation view respectfully of an alternative embodiment of the invention.

DETAILED DESCRIPTION

Figure 1:
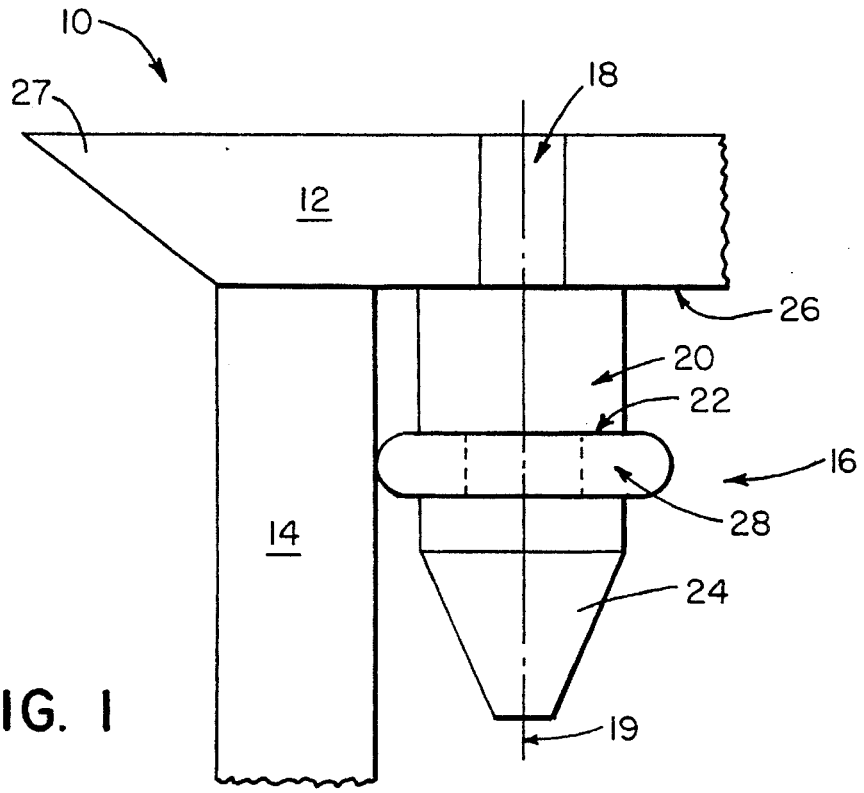
FIG. 1 is a partial elevation view of the closure lid in a container closing position.

Referring now to the drawings and particularly to FIG. 1, a pertinent portion of the container/closure assembly 10 is shown in a partial elevation view. The container/closure assembly 10 includes lid 12 (having a central vertical axis), container wall 14, and a container bottom (not shown). The container lid 12 includes beveled portion 27 about its perimeter to allow for easy removal of the lid 12. The container wall 14 extends upward from the container bottom and the container wall and bottom are preferably manufactured as an integral component. Significantly, the container/closure assembly includes lid extensions 16. It is to be understood that there are a plurality of lid extensions 16 secured to the lid 12, however, only one is detailed as they are all identical in configuration.

Lid extension 16 includes extension shaft 18, extension body 20, extension groove 22, and extension guide 24. Lid extension 16 is further defined by a central longitudinal axis 19. Preferably, extension shaft 18 is received in corresponding openings in lid 12 by force fit thereby securing the lid extension 16 to the lid. Preferably, the shaft 18 and opening in the lid 12 are circular in cross-section, however, alternative shapes may be utilized. Furthermore, the lid extension may be alternatively manufactured integrally with the closure lid 12. Once secured, extension body 20 extends from an inner surface 26 of closure lid 12. In the preferred embodiment, extension body 20 is circular in cross-section. Lid extension guide 24 is essentially a cone-shaped end which allows for guiding of the lid into the container during the initial stages for lid closing. The lid extension 16 is preferably a single integral unit and formed of plastic, such as polyethylene.

Figure 2:
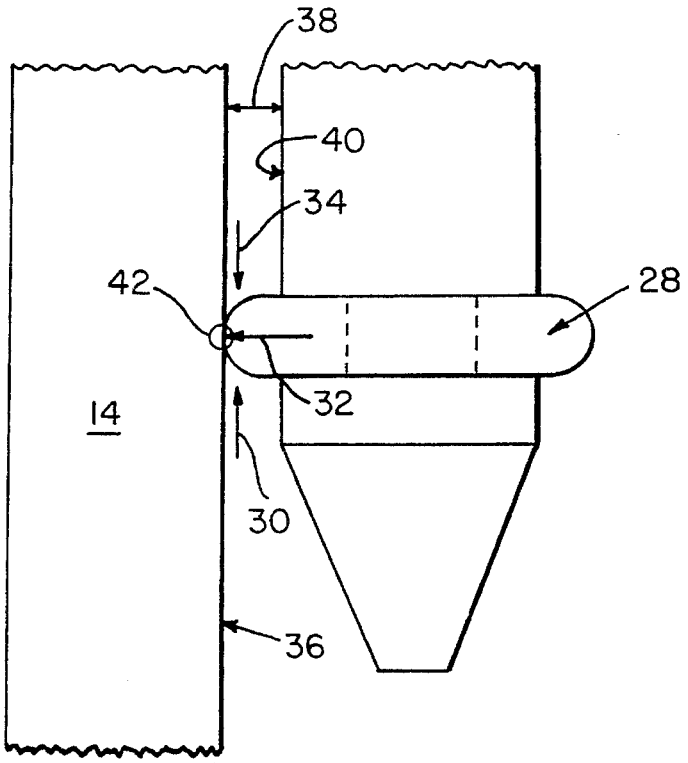
FIG. 2 is a partial elevation view of detailing the interaction between the lid extensions and container wall.

Significantly, the lid extension 16 includes pressure member 28. Preferably, pressure member is of the o-ring design and is secured in groove 22 of lid extension body 20. In this preferred o-ring embodiment, the pressure member 28 is further defined by an imaginary longitudinal axis; for example, central longitudinal axis 19 coincident with the central longitudinal axis defining the lid extension 16. The pressure member may alternatively comprise one or more protuberances extending from radial surface 40. The protuberances may be permanently secured to the surface 40 of the lid extension body 20 or removably secured in corresponding holes in lid extension body 20. Preferably, the pressure member is formed from a high surface friction material, such as rubber. It may alternatively, however, be formed from plastics or other suitable materials. FIG. 2 shows the interaction between the container wall 14 and the lid extension 16. The arrow 32 signifies the material expansion force acting against an inner surface 36 of container wall 14. Obviously, the larger the amount of pressure force 32, the more tightly the closure lid 12 is restrained on the container. In this, the greater the radial distance pressure member 28 extends beyond radial surface 40, the greater the pressure force 32. It should be noted that the radial extension of pressure member 28 beyond radial surface 40 is at least the radial distance signified by arrow 38. That is, the distance between radial surface 40 and surface 36 of container wall 14 is at least equal to the distance 38.

The surface friction forces 30 and 34 act along the wall surface 36, that is, normal to pressure force 32. The value of the frictional forces acting on the surface 36 of container wall 14 is directly proportional to the value of the pressure force 32. That is, $$f=n\cdot F$$

where f is frictional forces 30 and 34, F is pressure force 32, and n is the coefficient of friction which is a constant dependent on material of the contacting surfaces. It can be seen, the higher the value of pressure force 32, the higher the value of frictional forces 34. Obviously, the higher the value of frictional forces 30 and 34, the more securely held closure lid 12 will be on container 14.

The pressure member 28 is easily replaceable by removing the member 28 from its secured position within groove 22. This replaceable feature of the lid extension provides for a unique advantage over the prior art container/closure assemblies. After many opening/closing cycles (i.e., where the closure lid 12 is removed and then subsequently place on the container) the pressure members become worn and distorted thereby providing poor securement of the lid to the container. However, the pressure member may be easily replaced with a new pressure member 28 thereby providing for optimal lid holding forces. More importantly, however, the container/closure assembly user may adjust the pressure and frictional forces acting to maintain the lid in a secured position merely by changing the pressure member 28.

The pressure member design of this invention is further defined by the pressure contact point 42. This single pressure contact point 42 is preferably formed by use of an o-ring pressure member design. If the contact point 42 becomes worn from use, the o-ring is merely rotated to present a new contact point which interacts with the container wall surface 36. If the pressure member is in the form of a protuberance, then the size of the contact "point" will depend on the shape and form of the protuberance. In having a single pressure contact point on a given container wall surface 36, the container lid 12 will be capable of more controlled and easier opening/closing cycles. The container/closure assembly user will not have to undergo the difficulties involved in placing a tab into a groove in order to properly secure the container lid on the container.

FIGS. 3*a*–3*c* show alternative container/closure shapes within the scope of this invention. FIG. 3*a* shows a schematic plan cut-away view of a triangular cross-sectioned container/closure. FIG. 3*b* is a schematic plan cut-away view of the closure lid in a container closing position of a circular cross-sectioned shaped container/closure embodiment. FIG. 3*c* is a schematic plan cut-away view of the closure lid in a container closing position of a rectangular cross-sectioned shaped container/closure embodiment. In the embodiments of FIGS. 3*a*–3*c*, the lid extensions interacts with the inside surfaces of the container wall in the manner described above. In the embodiments depicted in FIGS. 3*a* and 3*c*, the lid extensions interact with the corners of the containers. It can be seen that the pressure member 28 will have single point contact 42 (assuming the pressure member is of the o-ring design) on the two adjacent container walls that form the container corner. Preferably, there will be an identical number of lid extensions as there are container corners (i.e., four lid extensions for the rectangular embodiment of FIG. 3*c* and three lid extensions for the triangular embodiment of FIG. 3*a*). In the circular cross-section embodiment of FIG. 3*b* there are at least three lid extensions interacting with a single wall 14. If the pressure member is of the o-ring design there will be a single contact point 42 for each pressure member 28.

FIGS. 4*a*–4*c* show alternative embodiments of the container/closure assembly. Specifically, the lid extensions of these embodiments interact with a corresponding outside surface of a container wall. These embodiments are preferable if there is a need for more usable volume space within the container.

FIGS. 5*a* and 5*b* show an alternative embodiment of the present invention. More specifically, there is shown a container/closure assembly 50 having lid extensions 52. In the embodiment of FIGS. 5*a* and 5*b*, lid extensions 52 extend the complete height of the container 54 such that a distal end 56 of the lid extension contacts or comes close to contacting the container bottom 58. This embodiment is useful to secure items at the bottom of the container 54. For example, a picture 60 may be secured at the bottom of the container. The closure 62 may be made of a transparent material so the assembly could be used as a picture frame whereby the picture is viewed through the closure 62. The lid extensions of this embodiment otherwise operate in the same manner as set forth above.

FIGS. 6*a* and 6*b* show yet another embodiment of the present invention. Specifically, there is shown a container/ closure assembly 64 which utilizes only one lid extension 66. This embodiment is preferably used as a compact disc container/closure assembly. In this embodiment, the pressure member 68 contacts at its periphery the inner surface of opening 70. The closure 72 is easily removed from the compact disc container by simply grasping the outer surface of the closure 72 and pulling upward so as to overcome the pressure and friction force supplied by the interaction of pressure member 68 and surface 70.

SUMMARY OF MAJOR ADVANTAGES OF THE INVENTION

After reading and understanding the foregoing detailed description of an inventive container/closure assembly in accordance with preferred embodiments of the invention, it will be appreciated that several distinct advantages of the subject container/closure assembly are obtained.

Without attempting to set forth all of the desirable features of the instant container/closure assembly, at least some of the major advantages include a container/closure assembly 10 having a lid 12 with lid extensions 16 extending from an inner surface of the lid 12. The lid extensions 16 include a pressure member 28 which interacts with a wall surface(s) 36 of the walls 14 of the container. Significantly, the pressure member 28 utilizes pressure forces 32 and frictional forces 30,34 to maintain the lid 12 in a secured position on the container.

The container/closure assembly 10 of the invention is a significant improvement over prior art container assemblies. The container/closure assembly 10 of the instant invention utilizes controlled pressure and frictional forces to maintain the lid 12 in a secured position without the need for tab and groove systems which possess many undesirable operational features. Moreover, the assembly of the present invention allows for easy opening and closing of the lid 12 by virtue of the pressure point design. Furthermore, utilization of replaceable pressure members 28 allows for controlled lid holding forces which allows a container/closure assembly user to adjust the assembly for particular needs.

Alternative embodiments of the present invention show the advantages achieved by the use of lid extensions. For example, the lid extension may be adapted for use in a picture frame to secure a picture at the bottom of a container and allow for easy replacement of the picture if desirable. Moreover, significant advantages are achieved when only a single lid extension is utilized, for example a container closure assembly used to store compact disc.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A container/closure assembly comprising:

container means consisting of a bottom portion and a wall portion, said wall portion having an inner and outer surface extending from said bottom portion such that a container volume and an open end is defined by said portions; and closure means adapted to cover said open end of said container means wherein said closure means comprises:

a lid means having an inner and outer surface and a central vertical axis; and a plurality of lid extensions having a central longitudinal axis, an outer radial surface, and being substantially circular in cross-section extending from said inner surface of said lid means and spaced circumferentially about said central vertical axis such that each of said central longitudinal axes of said lid extensions are substantially parallel to said central vertical axis of said lid means and when said lid means covers said open end of said container means, each of said lid extensions is positioned such that a predetermined radial distance exists between the outer radial surface of said lid extension and a surface of said wall portion of said container means; and pressure means secured to each of said lid extensions and radially extending a distance greater than said predetermined radial distance from said outer radial surface of said lid extension such that when said lid means covers said open end of said container means and said lid extensions are positioned adjacent said wall portion, said pressure means contacts and exerts a force against said surface of said wall portion;

whereby said closure means is secured to said container means when said closure means covers said open end and said pressure means contacts said surface of said wall portion.

2. A container/closure assembly as defined in claim 1 wherein said lid means further comprises grip means which allow a container user to easily manipulate said lid means between a secured position and a removed position.

3. A container/closure assembly as defined in claim 2 wherein said lid means has an outer perimeter and said grip means comprises a beveled edge formed on the outer perimeter of said lid means.

4. A container/closure assembly as defined in claim 1 wherein said surface of said wall portion is said inner surface of said wall portion.

5. A container/closure assembly as defined in claim 1 wherein said surface of said wall portion is said outer surface of said wall portion.

6. A container/closure assembly as defined in claim 1 wherein said pressure means comprises a circular ring having a central longitudinal axis secured to each of said lid extensions such that said central longitudinal axis of said circular ring is substantially parallel to said central longitudinal axis of said lid extension.

7. A container/closure assembly as defined in claim 6 wherein each of said lid extensions is formed with a radial groove to seat said circular ring.

8. A container/closure assembly as defined in claim 1 wherein said pressure means extends from said outer radial surface of said lid extension such that it makes contact with said surface of said wall portion only at a single point.

9. A container/closure assembly as defined in claim 1 wherein said wall portion consists of four walls extending from said bottom portion configured to form a substantially rectangular shaped container; and said lid means being of a substantially rectangular shape with four corner sections and having four of said lid extensions extending from said inner surface of said lid means whereby one of said lid extensions is located at each of said corner sections of said lid means; and each of said pressure means of said lid extensions extends from said outer radial surface of said lid extension such that it makes contact with the two adjacent walls which form a corresponding corner of said container means.

10. A container/closure assembly as defined in claim 9 wherein said pressure means comprises a circular ring having a central longitudinal axis secured to each of said lid extensions such that said central longitudinal axis of said circular ring is substantially parallel to said central longitudinal axis of said lid extension.

11. A container/closure assembly as defined in claim 1 wherein said wall portion is configured to form a substantially circular shaped container; and said lid means being of substantially circular shape with at least three of said lid extensions extending from said inner surface of said lid means.

12. A container/closure assembly as defined in claim 11 wherein said pressure means comprises a circular ring having a central longitudinal axis secured to each of said lid extensions such that said central longitudinal axis of said circular ring is substantially parallel to said central longitudinal axis of said lid extension.

13. A container/closure assembly as defined in claim 1 wherein said wall portion consist of three walls extending from said bottom portion configured to form a substantially triangular shaped container; and said lid means being of a substantially triangular shape with three corner sections and having three of said lid extensions extending from said inner surface of said lid means whereby one of said lid extensions is located at each of said corner sections of said lid means; and each of said pressure means of said lid extensions extends from said outer radial surface of said lid extension such that it makes contact with the two adjacent walls which form a corresponding corner of said container means.

14. A container/closure assembly as defined in claim 1 wherein said lid extension has a distal end removed from said inner surface of said lid means, said distal end configured such that said outer radial surface progressively tapers toward the central longitudinal axis of said extension.

15. A container/closure assembly as defined in claim 1 wherein said lid extensions extend approximately the full height of the container means such that a distal end of said lid extensions are adjacent said bottom portion of the container means.

16. A container/closure assembly comprising:

container means consisting of a bottom portion and a wall portion extending from said bottom portion such that a container volume and an open end is defined by said portions; and closure means adapted to cover said open end of said container means wherein said closure means comprises:

a lid means having an inner and outer surface and a central vertical axis; and a plurality of lid extensions having a central longitudinal axis, an outer radial surface, and extending from said inner surface of said lid means and spaced circumferentially about said central vertical axis such that each of said central longitudinal axes of said lid extensions are substantially parallel to said central vertical axis of said lid means and when said lid means covers said open end of said container means, each of said lid extensions is positioned such that a predetermined radial distance exists between the outer radial surface of said lid extension and a surface of said wall portion of said container means; and pressure means secured to each of said lid extensions and radially extending a distance greater than said predetermined radial distance from said outer radial surface of said lid extension such that when said lid means covers said open end of said container means and said lid extensions are positioned adjacent the wall portion, said pressure means contacts and exerts a force against said surface of said wall portion;

whereby said closure means is secured to said container means when said closure means covers said open end and said pressure means contacts said surface of said wall portion.

* * * * *